United States Patent [19]

Niebylski

[11] 4,175,927

[45] Nov. 27, 1979

[54] FUEL COMPOSITIONS FOR REDUCING HYDROCARBON EMISSIONS

[75] Inventor: Leonard M. Niebylski, Birmingham, Mich.

[73] Assignee: Ethyl Corporation, Richmond, Va.

[21] Appl. No.: 890,494

[22] Filed: Mar. 27, 1978

[51] Int. Cl.[2] ..... C10L 1/18

[52] U.S. Cl. ..... 44/68; 44/66; 44/70

[58] Field of Search ..... 44/66, 68, 70

[56] References Cited

U.S. PATENT DOCUMENTS

| | | | |
|---|---|---|---|
| 2,818,417 | 12/1957 | Brown et al. | 44/68 |
| 2,839,552 | 6/1958 | Shapiro et al. | 44/68 |
| 2,948,598 | 8/1960 | Brehm | 44/66 |
| 2,976,304 | 3/1961 | DeWitt et al. | 44/68 |
| 3,127,351 | 3/1964 | Brown et al. | 44/68 |
| 3,834,882 | 9/1974 | Garth | 44/66 |
| 3,925,030 | 12/1975 | Garth | 44/66 |
| 3,950,145 | 4/1976 | Niebylski | 44/68 |
| 3,958,955 | 5/1976 | Gautreaux | 44/68 |

*Primary Examiner*—Winston A. Douglas
*Assistant Examiner*—Y. Harris-Smith
*Attorney, Agent, or Firm*—Donald L. Johnson; Robert A. Linn; Willard G. Montgomery

[57] ABSTRACT

Exhaust hydrocarbon emissions of an internal combustion engine being operating on gasoline containing a cyclopentadienyl manganese antiknock are reduced by the addition of a dimer or a trimer acid or mixture of a dimer and a trimer acid produced by the polymerization or condensation of an unsaturated aliphatic monocarboxylic acid having between 16 and 18 carbon atoms per molecule to the gasoline.

36 Claims, No Drawings

FUEL COMPOSITIONS FOR REDUCING HYDROCARBON EMISSIONS

BACKGROUND OF THE INVENTION

Fuels used in today's automotive engine cause deposits to be formed during combustion. Such deposits collect on parts of the combustion chamber including valves, spark plugs, and cylinder heads and walls. Formation of these deposits can result in increased exhaust emissions.

Cyclopentadienyl manganese compounds are excellent antiknocks in gasolines used to operate internal combustion engines and have proven to be especially beneficial in solving some of the problems present when low-lead or lead-free gasolines are used with internal combustion engines.

Use of such compounds as antiknocks is described in U.S. Pat. Nos. 2,818,417, 2,839,552, and 3,127,351, all incorporated herein by reference.

SUMMARY OF THE INVENTION

According to the present invention, exhaust hydrocarbon emissions of internal combustion engines operating on gasoline containing a cyclopentadienyl manganese antiknock compound are reduced by gasoline compositions containing a dimer or trimer acid or a mixture of a dimer and trimer acid produced by the polymerization or condensation of an unsaturated aliphatic monocarboxylic acid having between 16 and 18 carbon atoms per molecule.

DESCRIPTION OF THE PREFERRED EMBODIMENT

The essence of the present invention resides in the reduction of exhaust emissions of internal combustion engines which burn gasoline containing an organomanganese compound. This reduction in exhaust emission is effected by addition to the gasoline of a dimer or a trimer acid or mixture of a dimer and a trimer acid produced by the polymerization or condensation of an unsaturated aliphatic monocarboxylic acid having between 16 and 18 carbon atoms per molecule to the gasoline. Accordingly, a preferred embodiment is a gasoline suitable for use in an internal combustion engine and containing an amount of organomanganese compound, preferably a cyclopentadienyl manganese tricarbonyl, sufficient to increase the gasoline's antiknock effectiveness, and also containing an exhaust emission reducing amount of a dimer or a trimer acid or a mixture thereof produced by the polymerization or condensation of an unsaturated aliphatic monocarboxylic acid having between 16 and 18 carbon atoms per molecule.

A further embodiment of the present invention is a method for reducing exhaust emissions of internal combustion engines which operate on a gasoline containing an organomanganese compound by the addition to the gasoline of an exhaust emission reducing amount of a dimer acid, a trimer acid or a mixture of a dimer and trimer acid produced by the polymerization or condensation of an unsaturated aliphatic monocarboxylic acid having between 16 and 18 carbon atoms per molecule.

Liquid hydrocarbon fuels of the gasoline boiling range are mixtures of hydrocarbons having a boiling range of from about 80° F. to about 430° F. Of course, these mixtures can contain individual constituents boiling above or below these figures. These hydrocarbon mixtures contain aromatic hydrocarbons, saturated hydrocarbons and olefinic hydrocarbons. The bulk of the hydrocarbon mixture is obtained by refining crude petroleum by either straight distillation or through the use of one of the many known refining processes, such as thermal cracking, catalytic cracking, catalytic hydroforming, catalytic reforming, and the like. Generally, the final gasoline is a blend of stocks obtained from several refinery processes. The final blend may also contain hydrocarbons made by other procedures such as alkylate made by the reaction of $C_4$ olefins and butanes using an acid catalyst such as sulfuric acid or hydrofluoric acid.

Preferred gasolines are those having a Research Octane Number of at least 85. A more preferred Research Octane Number is 90 or greater. It is also preferred to blend the gasoline such that it has a content or aromatic hydrocarbons ranging from 10 to about 60 volume percent, an olefinic hydrocarbon content ranging from 0 to about 30 volume percent, and a saturate hydrocarbon content ranging from about 40 to 80 volume percent, based on the whole gasoline.

In order to obtain fuels having properties required by modern automotive engines, a blending procedure is generally followed by selecting appropriate blending stocks and blending them in suitable proportions. The required octane level is most readily accomplished by employing aromatics (e.g. BTX, catalytic reformate or the like), alkylate (e.g. $C_{6-9}$ saturates made by reacting $C_4$ olefins with isobutane using a HF or $H_2SO_4$ catalyst), or blends of different types.

The balance of the whole fuel may be made up of other components such as other saturates, olefins, or the like. The olefins are generally formed by using such procedures as thermal cracking, catalytic cracking and polymerization. Dehydrogenation of paraffins to olefins can supplement the gaseous olefins occurring in the refinery to produce feed material for either polymerization or alkylation processes. The saturated gasoline components comprise paraffins and naphthenates. These saturates are obtained from (1) virgin gasoline by distillation (straight run gasoline), (2) alkylation processes (alkylates) and (3) isomerization procedures (conversion of normal paraffins to branched chain paraffins of greater octane quality). Saturated gasoline components also occur in so-called natural gasolines. In addition to the foregoing, thermally cracked stocks, catalytically cracked stocks and catalytic reformates contain saturated components.

The classification of gasoline components into aromatics, olefins and saturates is well recognized in the art. Procedures for analyzing gasolines and gasoline components for hydrocarbon composition have long been known and used. Commonly used today is the FIA analytical method involving fluorescent indicator adsorption techniques. These are based on selective adsorption of gasoline components on an activated silica gel column. The components being concentrated by hydrocarbon type in different parts of the column. Special fluorescent dyes are added to the test sample and are also selectively separated with the sample fractions to make the boundaries of the aromatics, olefins and saturates clearly visible under ultraviolet light. Further details concerning this method can be found in "1969 Book of ASTM Standards," January 1969 Edition, under ASTM Test Designation D 1319—66T.

The motor gasolines used in formulating the improved fuels of this invention generally have initial boiling points ranging from about 80° to about 105° F. and final boiling points ranging from about 380° to about 430° F. as measured by the standard ASTM distillation procedure (ASTM D—86). Intermediate gasoline fractions boil away at temperatures within these extremes.

From the standpoint of minimizing atmospheric pollution to the greatest extent possible, it is best to keep the olefin content of the fuel as low as can be economically achieved as olefins reportedly give rise to smog-forming emissions, especially from improperly adjusted vehicular engines. Accordingly, in the preferred base stocks of this invention the olefin content will not exceed about 10 volume percent and the most particularly preferred fuels will not contain more than about 5 percent olefins. Table 1 illustrates the hydrocarbon type makeup of a number of particularly preferred fuels for use in this invention.

TABLE 1

Hydrocarbon Blends of Particularly Preferred Base Fuels

| Fuel | Aromatics | Volume Percentage Olefins | Saturates |
|---|---|---|---|
| A | 35.0 | 2.0 | 63.0 |
| B | 40.0 | 1.5 | 58.5 |
| C | 20.0 | 2.5 | 77.5 |
| D | 33.5 | 1.0 | 65.5 |
| E | 36.5 | 2.5 | 61.0 |
| F | 43.5 | 1.5 | 55.0 |
| G | 49.5 | 2.5 | 48.0 |

It is also desirable to utilize base fuels having a low sulfur content as the oxides of sulfur tend to contribute an irritating and choking character to smog and other forms of atmospheric pollution. Therefore, to the extent it is economically feasible, the fuel will contain not more than about 0.1 weight percent of sulfur in the form of conventional sulfur-containing impurities. Fuels in which the sulfur content is no more than about 0.02 weight percent are especially preferred for use in this invention.

Normally the gasoline to which this invention is applied is lead-free or substantially lead-free, although small amounts of organolead additives usually employed to give fuels of improved performance quality such as tetraalkyllead antiknocks including tetramethyllead, tetraethyllead, physical or redistributed mixtures of tetramethyllead and tetraethyllead, and the like may be present therein. The gasoline may also contain antiknock quantities of other agents such as cyclopentadienyl nickel nitrosyl, N-methyl aniline, and the like. Antiknock promoters such as tert-butyl acetate may be included. The gasoline may further contain blending agents or supplements such as methanol, isopropanol, t-butanol and the like. Antioxidants such as 2,6-di-tert-butylphenol, 2,6-di-tert-butyl-p-cresol, phenylenediamines such as N,N'-di-sec-butyl-p-phenylenediamine, N-isopropylphenylenediamine, and the like, may be present. Likewise, the gasoline can contain dyes, metal deactivators, or other types of additives recognized to serve some useful purpose in improving the gasoline quality.

Cyclopentadienyl manganese tricarbonyls are known antiknocks and their preparation and use as described in U.S. Pat. Nos. 2,818,417, 2,839,552, and 3,127,351. An important antiknock of this type is methylcylopentadienyl manganese tricarbonyl. The amount of the cyclopentadienyl manganese tricarbonyl added to the gasolines should be an amount adequate to increase its antiknock effectiveness. This has generally been found to be in the range of from about 0.005 to 10 grams per gallon of manganese as a cyclopentadienyl manganese tricarbonyl. A preferred range is from about 0.05 to 6 grams of manganese per gallon as a cyclopentadienyl manganese tricarbonyl. A more preferred range is from about 0.05 to about 0.25 grams of manganese per gallon, and a most preferred range is from about 0.05 to about 0.125 grams of manganese per gallon as methylcyclopentadienyl manganese tricarbonyl.

The dimerized and trimerized unsaturated fatty acid component of the present invention is preferably a dimer or trimer of a comparatively long chain unsaturated fatty acid, i.e., and acid having about 16 or 18 carbon atoms, such as linoleic acid. When two molecules of linoleic acid react with one another, the product is a dimer acid. Similarly, when three molecules interact, the product is a trimer. However, it is to be understood that for purposes of this invention, one may use a product derived by reacting one molecule of one unsaturated fatty acid with a molecule of another unsaturated fatty acid. Similarly, one can condense one molecule of three different acids, or 2 molecules of one acid with one molecule of another to produce a trimeric product suitable for this invention. It is also to be understood that mixtures of the above described materials can be used. The dimer and trimer or mixtures of these as described above can be made by such procedures as set forth in Landis et al, U.S. Pat. No. 2,632,695. The dimer of linoleic acid has been found to be particularly suitable for use in the present invention. Particularly preferred is a 40 percent mixture of a dimer of linoleic acid in kerosene.

Commercial dimer and trimer products are highly efficacious components of compositions of this invention. Commercial products that have been found to be particularly effective include those dimer acid products prepared by the Humko Sheffiend Chemical Company and known to the trade as Hystrene 3695, Hystrene 3687, Hystrene 3680, and Hystrene 3675. These products have the following characteristics:

| PRODUCT | Hystrene 3695 | Hystrene 3687 | Hystrene 3680 | Hystrene 3675 |
|---|---|---|---|---|
| SPECIFICATIONS | | | | |
| Neut. Eq. | 283–289 | 284–295 | 287–299 | 285–297 |
| Acid Value | 194–198 | 190–198 | 190–197 | 189–197 |
| Sap Value | 198–202 | 195–201 | 192–200 | 191–199 |
| Color, Gard., Max. | 5 | 7 | 8 | 9 |
| % Monomer, Max. | 1.5 max. | 1.0 max. | 1.0 max. | 1.0 max. |
| TYPICAL | | | | |
| % Dimer | 95 | 87 | 83 | 75 |
| % Trimer | 4 | 13 | 17 | 25 |
| % Monomer | 1 | trace | trace | trace |
| Dimer/Trimer Ratio | 36:1 | 10:1 | 7.3:1 | 4.5:1 |
| Refrac. Index @ 25° C. | 1.4830 | 1.4842 | 1.4839 | 1.4853 |

-continued

| PRODUCT | Hystrene 3695 | Hystrene 3687 | Hystrene 3680 | Hystrene 3675 |
|---|---|---|---|---|
| Spec. Grav. @ 25°/25° C. | 0.952 | 0.953 | 0.954 | 0.955 |
| Spec. Grav. @ 100°/25° C. | 0.905 | 0.907 | 0.908 | 0.908 |
| Lbs./Gal. @ 25° C. | 7.94 | 7.95 | 7.96 | 7.96 |
| Pour Pt., °F. | 17 | 13 | 24 | 25 |
| Flash Pt., °F., C.O.C. | 550 | 580 | 580 | 600 |
| Fire Pt., °F. | 625 | 620 | 625 | 625 |
| Visc. @ 25° C. Cstks. | 6800 | 7600 | 8000 | 9000 |
| Visc. @ 60° C. Cstks. | 550 | 570 | 630 | 660 |
| Unsap | 0.5 | 0.5 | 1.0 | 1.0 |
| Surf. Tens. @ 25° C. Dynes/cm | 26.5 | 26.3 | 26.0 | 26.3 |

HumKo can supply versions of Hystrene 3675 with varying monomer contents. They are designated by a letter suffix: A = 1–2% monomer, B = 2–3% monomer, C = 3–4% monomer, and D = 4–5% monomer. The variation in the percent monomer will, of course, change the above physical characteristics of our Hystrene 3675.

The amounts of hydrocarbon emission control additive compound, as for example, the dimer of linoleic acid, sufficient to reduce the hydrocarbon emission level is at least to some extent dependent upon the amount of manganese present in the gasoline. Generally, the greater the concentration of manganese, the greater the amount of additive compound needed to reduce deposit related hydrocarbon emission levels. A typical concentration range is from about 0.25 grams per gallon, to about 10 grams per gallon. It is to be understood that concentrations somewhat outside this ranfge can be used if desired. The particularly preferred amount of compound is about 0.5–1.5 grams per gallon. There is no real known upper limit on the concentration of the hydrocarbon emission reducing compound. In general, one uses an additive quantity having adequate exhaust reducing properties.

The following examples, in which all parts are by weight, illustrate the preparation of the products of this invention.

EXAMPLE 1

To a blending vessel was added 30 gallons of a reformate gasoline having the following properties:

| | |
|---|---|
| Boiling range | 87°–408° F. |
| Research octane number | 93 |
| Aromatics (volume percent) | 28.5 |
| Olefinics (volume percent) | 8.0 |
| Aliphatics (volume percent) | 63.5 |

To this gasoline was added an amount of methylcyclopentadienyl manganese tricarbonyl sufficient to provide 0.125 grams of manganese per gallon of fuel. There was then added to the gasoline a sufficient amount of the aforedescribed dimer of linoleic acid—40 percent mixture of dimer acid—in kerosene to give a concentration of 0.4 grams per gallon of fuel. The mixture was then agitated until thoroughly mixed. The result was a gasoline having reduced emission increasing properties.

EXAMPLE 2

The preparation of Example 1 was repeated and a product obtained having an amount of methylcyclopentadienyl manganese tricarbonyl sufficient to provide 0.125 grams of manganese per gallon of fuel and sufficient dimer acid to give a concentration of 0.4 grams of dimer acid per gallon of fuel.

EXAMPLE 3

The preparation of Example 1 was repeated except that a commercially prepared 95 percent pure dimer acid mixed with 4 percent trimer and one percent monomer acid product previously identified as Hystrene 3695 was substituted for the dimer acid (40 percent mixture in kerosene) of Example 1. An amount of Hystrene 3695 was added to the gasoline composition to give a concentration of 1.0 gram of the 95 percent pure dimer acid to each one gallon of fuel.

EXAMPLE 4

The preparation of Example 1 was repeated except that a commercially prepared trimer acid mixture prepared by Humko Sheffield Chemical Company and designated Hystrene 5460, was substituted for the dimer acid (40 percent mixture in kerosene) in Example 1. The trimer acid was 60 percent pure mixed with 39 percent dimer acid and one percent monomer acid.

Tests were run to illustrate the unusual and beneficial effects of the products of this invention on reducing exhaust emissions. In such tests, an Oldsmobile type single cyclinder engine with a 9.5:1 compression ratio is used, using Shell 10W-40 multigrade oil and a 28.5 percent aromatic fuel produced by Amoco and designated Amoco 91 containing 0.125 grams per gallon of fuel of methylcyclopentadienyl manganese tricarbonyl antiknock.

Engine Preparation

Before each test, the combustion chamber, valves and valve parts are cleaned of deposits and the valves are reseated. The old oil is drained, the oil pan is flushed with new oil and then filled with new oil. A new AC-45 spark plug is installed and the fuel lines are flushed with test fuel.

Start of Test Procedure

The engine is started on the aforementioned Amoco 91 fuel from a fuel burette, at 50 percent wide open throttle, at a speed of 1370 r.p.m., an air/fuel ratio of about 14.7:1 and with an ignition timing of 10 BTC. These conditions are maintained until the water and oil sump are at 160°±5° F. and the carburetor air is at 110°±5° F. At this condition exhaust measurements are made for hydrocarbon and carbon monoxide so as to detect any engine changes compared to other tests in the same engine. Hydrocarbon measurements are made with a Beckman 400 Flame Ionization Hydrocarbon Detector. Carbon monoxide is measured with a Beckman 315A Non-Dispersive Infrared Analyzer. Measurements are taken at two sampling points, one at the engine exhaust port and the other several inches from the engine after a mixing element.

The engine is then switched to the test fuel and the air/fuel ratio is adjusted to the stoichiometric air/fuel ratio required by the test fuel. At this time exhaust hydrocarbon emission measurements are made, giving a start-of-test-result, whereupon the engine is shut down and the oil level zeroed.

Time Accumulation Schedule

The engine is restarted with test fuel on a cycling schedule alternating between the following conditions:

| | | |
|---|---|---|
| Time, seconds | 45 | 135 |
| Speed, r.p.m. | 750–850 | 1,370 |
| Load | None | 50 percent W.O.T.[1] |
| Air/Fuel Ratio | 14.2 | Stoichiometric |
| Ignition Timing | | 10° BTC |
| Oil Sump, °F. | | 165 ± 5 |
| Water, °F. | | 165 ± 5 |
| Carburetor Air, °F. | 110 ± 5 | |

[1]Wide Open Throttle

The test is run for 100 hours with emission measurements made every 24 hours.

Periodic Emission Ratings

After about each 24 hours of test time, hydrocarbon emission measurements are taken at 50 percent W.O.T. after which the engine is returned to the cycling schedule.

End of Test Procedure

At the end of 100 hours of test, hydrocarbon emission measurements are taken at 50 percent W.O.T. and the engine is returned to a cycling schedule for a 1–2 hour period and then shut down. Oil consumption is then measured in ml/hr.

Using this procedure, the following results in terms of the percent of reduction in exhaust hydrocarbon emission were obtained using the emission reducing products of Examples 1, 2, 3 and 4.

TABLE I

| Additive | Concentration, g. Mn/gal. fuel | Reduction of: Emission Increase % Measured at Engine Exhaust Port | Reduction of: Emission Increase % Measured 8–10 inches Downstream from Exhaust Port |
|---|---|---|---|
| Product of Example 1 | 0.4 | 79 | 93 |
| Product of Example 2 | 0.4 | 45 | 35 |
| Product of Example 3 | 1.0 | 23 | ...* |
| Product of Example 4 | 1.0 | 35 | ...* |
| | | 48** | ...* |

*Measurements taken only at exhaust port.

**Reduction of emission increase percent at the end of 102 hours.

As these results show, the emission reducing additives of the present invention effectively reduce exhaust emissions from engines operating on gasoline containing a cyclopentadienyl manganese antiknock.

I claim:

1. As a composition of matter, a gasoline for an internal combustion engine comprising
   (i) an organomanganese compound, and
   (ii) an exhaust emission reducing amount of a compound selected from a dimer acid, a trimer acid or a mixture of a dimer and trimer acid produced by the polymerization or condensation of an unsaturated aliphatic monocarboxylic acid having between 16 and 18 carbon atoms per molecule.

2. The composition of claim 1 wherein said organomanganese compound is a cyclopentadienyl manganese tricarbonyl.

3. The composition of claim 2 wherein said cyclopentadienyl group is a hydrocarbon group containing 5 to 17 carbon atoms.

4. The composition of claim 3 wherein said cyclopentadienyl group is methylcyclopentadienyl.

5. The composition of claim 1 wherein said exhaust emission reducing compound is the dimer acid derived from linoleic acid.

6. The composition of claim 5 containing from about 0.25 to about 10.0 grams per gallon of gasoline of said dimer acid derived from linoleic acid.

7. The composition of claim 6 containing from about 0.5 to about 1.5 grams per gallon of gasoline of said dimer acid of linoleic acid.

8. As a composition of matter, a gasoline for an internal combustion engine comprising
   (i) an organomanganese antiknock compound in an amount sufficient to improve the antiknock characteristics of said gasoline, and
   (ii) an exhaust emission reducing amount of a compound selected from a dimer acid, a trimer acid or a mixture of a dimer and trimer acid produced by the polymerization or condensation of an unsaturated aliphatic monocarboxylic acid having between 16 and 18 carbon atoms per molecule.

9. The composition of claim 8 wherein said organomanganese compound is a cyclopentadienyl manganese tricarbonyl.

10. The composition of claim 9 wherein said cyclopentadienyl group is a hydrocarbon group containing 5 to 17 carbon atoms.

11. The composition of claim 10 wherein said cyclopentadienyl group is methylcyclopentadienyl.

12. The composition of claim 11 containing from about 0.005 to about 10.0 grams of manganese per gallon of gasoline as methylcyclopentadienyl manganese tricarbonyl.

13. The composition of claim 12 containing from about 0.05 to about 6.0 grams of manganese per gallon of gasoline as methylcyclopentadienyl manganese tricarbonyl.

14. The composition of claim 13 containing from about 0.05 to about 0.25 grams of manganese per gallon of gasoline as methylcyclopentadienyl manganese tricarbonyl.

15. The composition of claim 14 containing from about 0.05 to about 0.125 grams of manganese per gallon of gasoline as methylcyclopentadienyl manganese tricarbonyl.

16. The composition of claim 8 wherein said exhaust emission reducing compound is the dimer acid derived from linoleic acid.

17. The composition of claim 16 containing from about 0.25 to about 10.0 grams per gallon of gasoline of said dimer acid of linoleic acid.

18. The composition of claim 17 containing from about 0.5 to about 1.5 grams per gallon of gasoline of said dimer acid of linoleic acid.

19. A method for reducing exhaust emission from an internal combustion engine that operates on a gasoline containing an organomanganese compound which method comprises adding to said gasoline an exhaust emission reducing amount of a dimer acid, a trimer acid or a mixture of a dimer acid and trimer acid produced by the polymerization or condensation of an unsaturated aliphatic monocarboxylic acid having between 16 and 18 carbon atoms per molecule.

20. The method of claim 19 wherein said organomanganese compound is a cyclopentadienyl manganese compound.

21. The method of claim 20 wherein said cyclopentadienyl group is a hydrocarbon group containing 5 to 17 carbon atoms.

22. The method of claim 21 wherein said cyclopentadienyl group is methylcyclopentadienyl.

23. The method of claim 19 wherein said exhaust emission reducing compound is the dimer acid derived from linoleic acid.

24. The method of claim 23 wherein said exhaust emission reducing amount of said dimer acid of linoleic acid is from about 0.25 to about 10.0 grams per gallon of gasoline.

25. The method of claim 24 wherein said exhaust emission reducing amount of said dimer acid derived from linoleic acid is from about 0.5 to about 1.5 grams per gallon of gasoline.

26. A method for reducing exhaust emissions from an internal combustion engine that operates on a gasoline containing an organomanganese antiknock compound in an amount sufficient to improve the antiknock characteristics of said gasoline which method comprises adding to said gasoline an exhaust emission reducing amount of a dimer acid, a trimer acid or a mixture of a dimer and a trimer acid produced by the polymerization or condensation of an unsaturated aliphatic monocarboxylic acid having between 16 and 18 carbon atoms per molecule.

27. The method of claim 26 wherein said organomanganese compound is a cyclopentadienyl manganese compound.

28. The method of claim 27 wherein said cyclopentadienyl group is a hydrocarbon group containing 5 to 17 carbon atoms.

29. The method of claim 28 wherein said cyclopentadienyl group is methylcyclopentadienyl.

30. The method of claim 29 wherein the amount of said methylcyclopentadienyl manganese tricarbonyl is sufficient to provide from about 0.005 to about 10 grams of manganese per gallon of gasoline.

31. The method of claim 30 wherein the amount of said methylcyclopentadienyl manganese tricarbonyl is sufficient to provide from about 0.05 to about 6.0 grams of manganese per gallon of gasoline.

32. The method of claim 31 wherein the amount of said methylcyclopentadienyl manganese tricarbonyl is sufficient to provide from about 0.05 to about 0.25 grams of manganese per gallon of gasoline.

33. The method of claim 32 wherein the amount of said methylcyclopentadienyl manganese tricarbonyl is sufficient to provide from about 0.05 to about 0.125 grams of manganese per gallon of gasoline.

34. The method of claim 26 wherein said exhaust emission reducing compound is the dimer acid derived from linoleic acid.

35. The method of claim 34 wherein said exhaust emission reducing amount of said dimer acid derived from linoleic acid is from about 0.25 to about 10.0 grams per gallon of gasoline.

36. The method of claim 35 wherein said exhaust emission reducing amount of said dimer acid derived from linoleic acid is from about 0.5 to about 1.5 grams per gallon of gasoline.

* * * * *